United States Patent [19]

Brian

[11] Patent Number: 4,573,633

[45] Date of Patent: Mar. 4, 1986

[54] CORNER LOCK ON PAPERBOARD BAKING AND SHIPPING TRAY

[75] Inventor: James A. Brian, San Antonio, Tex.

[73] Assignee: Crown Zellerbach Corporation, San Francisco, Calif.

[21] Appl. No.: 624,153

[22] Filed: Jun. 25, 1984

[51] Int. Cl.[4] ..... B65D 5/22

[52] U.S. Cl. ..... 229/32; 229/34 A; 229/34 HW; 229/35

[58] Field of Search ..... 229/34 R, 34 A, 34 HW, 229/32, 35, 33, 36

[56] References Cited

U.S. PATENT DOCUMENTS

| | | | |
|---|---|---|---|
| 2,345,716 | 4/1944 | Smith | 229/34 HW |
| 2,373,730 | 4/1945 | Williamson et al. | 229/34 A |
| 2,931,556 | 4/1960 | Muise | 229/34 R |
| 3,756,497 | 9/1973 | Stewart | 229/93 |

FOREIGN PATENT DOCUMENTS

| | | | |
|---|---|---|---|
| 444606 | 10/1912 | France | 229/35 |
| 745884 | 3/1956 | United Kingdom | 229/34 HW |
| 894835 | 4/1962 | United Kingdom | 229/34 R |
| 1075553 | 7/1967 | United Kingdom | 229/34 R |

*Primary Examiner*—William Price
*Assistant Examiner*—Gary E. Elkins
*Attorney, Agent, or Firm*—Thomas R. Lampe

[57] ABSTRACT

A paperboard baking and shipping tray including channel defining members at opposed ends and locking panels positioned therein with only a single surface of the blank from which the tray is formed being exposed to the tray interior.

2 Claims, 9 Drawing Figures

FIG. 1.
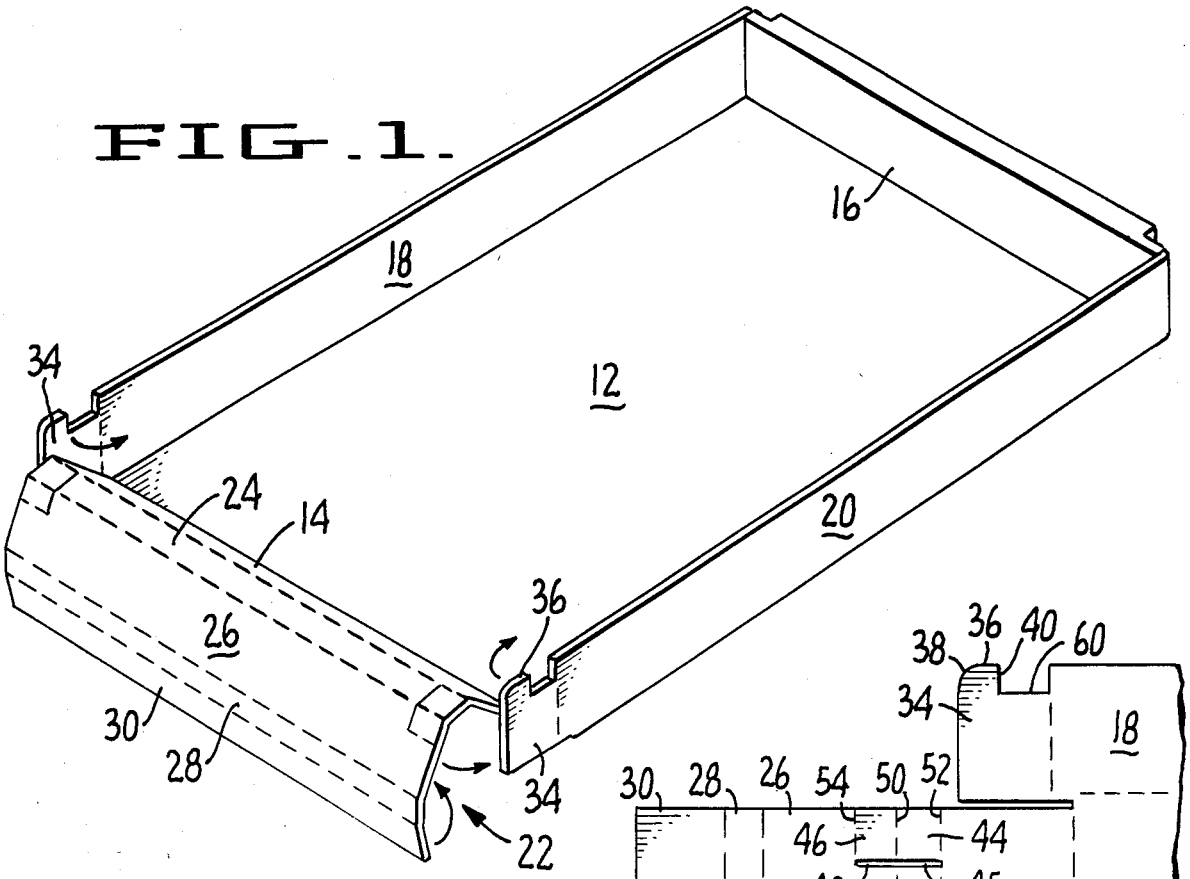
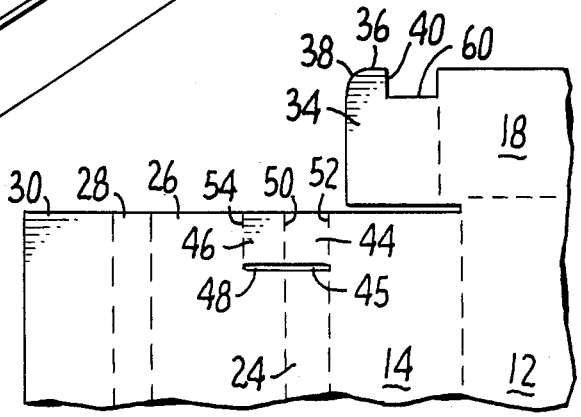
FIG. 2.
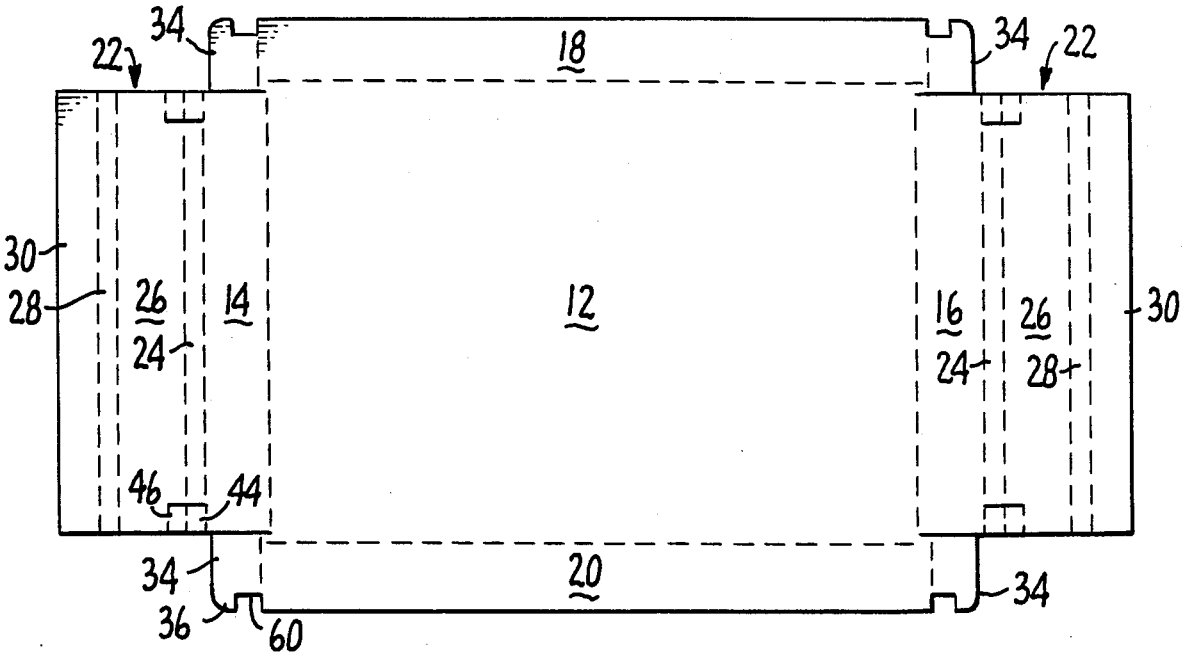
FIG. 3.

CORNER LOCK ON PAPERBOARD BAKING AND SHIPPING TRAY

BACKGROUND AND SUMMARY OF THE INVENTION

This invention relates to a paperboard self-locking tray for baking and transporting cake or the like.

Paperboard trays are known for such purpose, but it is conventional practice to construct prior art self-locking trays from blanks having grease resistant coatings on both sides thereof. This practice has been required because the self-locking feature conventionally utilizes fold constructions which expose both sides of the blank to the interior of the finished tray.

The tray of the present invention is of the self-locking type, but the fold and lock construction utilized therein does not require use of a blank coated on both sides. Tray costs are therefore reduced. In addition, the tray construction of the present invention utilizes a simple and inexpensive positive locking feature which insures tray integrity and stability after its formation from the single piece blank employed in its construction. The tray has sufficient strength and rigidity to be used as a shipping container for the cake or the like baked in it.

BRIEF DESCRIPTION OF THE DRAWINGS

FIG. 1 is a perspective view of a partially assembled tray constructed in accordance with the teachings of the present invention;

FIG. 2 is a plan view of a unitary blank used to construct the tray shown in FIG. 1;

FIG. 3 is an enlarged view illustrating certain blank elements of the positive locking construction of the invention;

DETAILED DESCRIPTION

Figure 4:
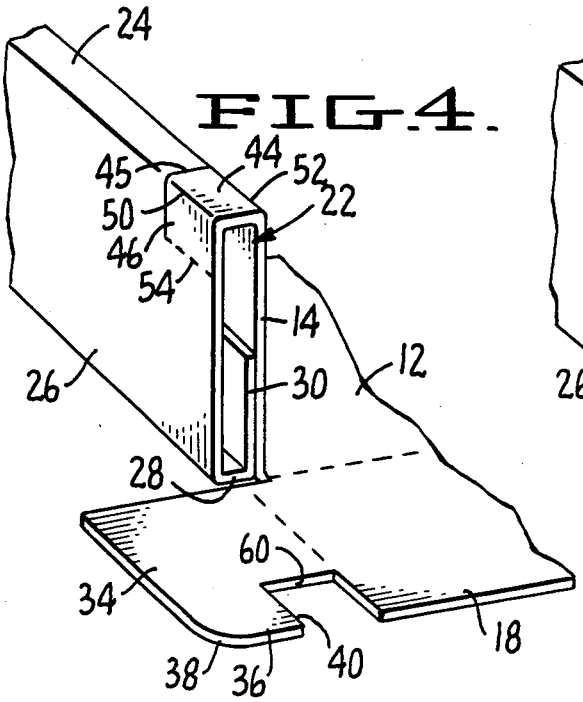
FIGS. 4–7 are enlarged perspective views of the blank elements shown in FIG. 4 during progressive stages in the assembly of the tray.

Referring now to the drawings, FIG. 2 illustrates a unitary paperboard blank used to construct the tray of the present invention. The blank includes a bottom wall panel 12, a first pair of side wall panels 14, 16 connected to opposite sides of the bottom wall panel along fold lines, and a second pair of side wall panels 18, 20 connected to opposite sides of the bottom wall panel along fold lines.

Channel defining members 22 are connected to each of the first pair of sidewall panels 14, 16. Each of the channel defining members 22 comprises a plurality of panels foldable relative to one another to define an open-ended channel. The channel defining members 22 each includes a first channel panel 24 connected to one of the first pair of side wall panels and adapted to extend outwardly therefrom, a second channel panel 26 attached along a fold line to the first channel panel and adapted to extend downwardly therefrom substantially parallel to the one side wall panel and spaced therefrom, a third channel panel 28 attached along a fold to the second channel panel and adapted to extend inwardly toward the one side wall panel, and a fourth channel panel 30 attached along a fold line to the third channel panel and adapted to extend upwardly from the third channel panel adjacent to said one side wall panel. Reference may be had to FIG. 1 for an illustration of how the channel panels 24–30 are folded relative to one another and to side wall panel 14 to form an open-ended channel.

Locking panels 34 extend from the ends of each of the second pair of side wall panels 18, 20 and are positionable in the channels when the tray is assembled to maintain the first and second pairs of side wall panels substantially perpendicular to the bottom wall panel with only a single surface of the blank, i.e., the baking surface, exposed to the tray interior. Each locking panel 34 is connected to its associated side wall panel along a fold line. Each locking panel includes a lock tab 36 having a curved surface 38 and a straight surface 40.

Figure 5:
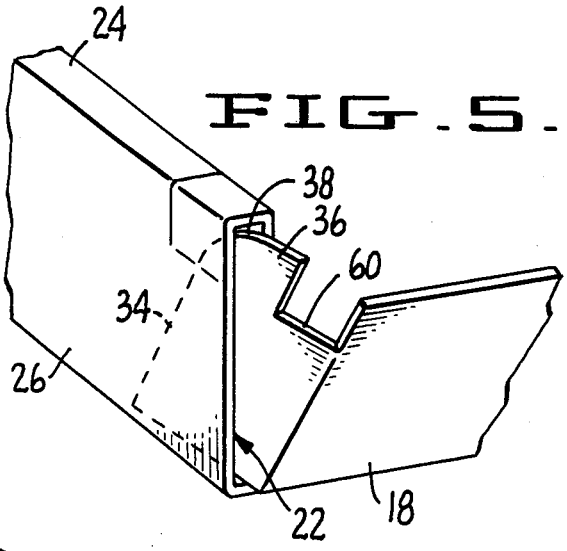
Figure 6:
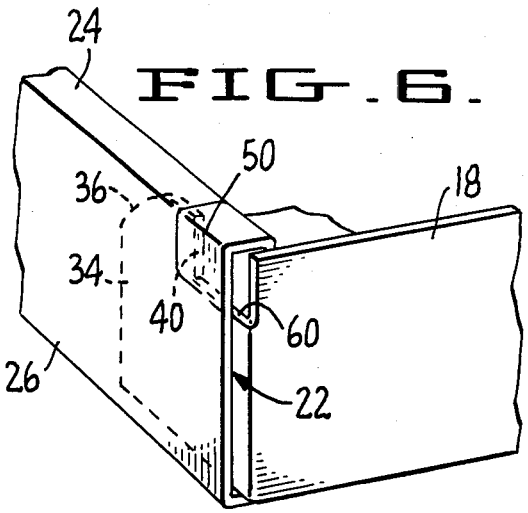
Figure 7:
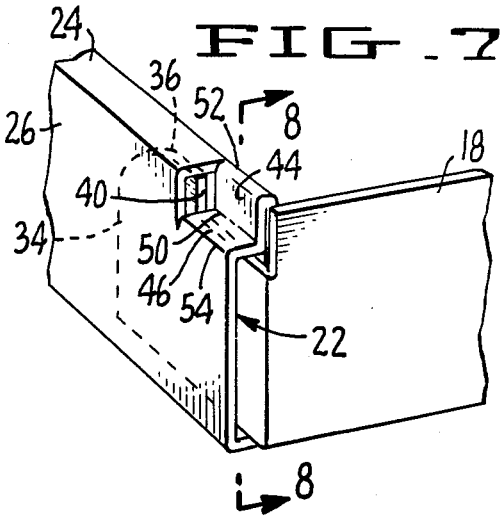
Figure 8:
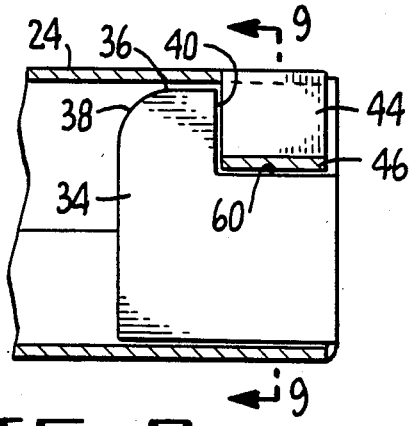
FIG. 8 is a sectional view taken along the line 8—8 of FIG. 7.
Figure 9:
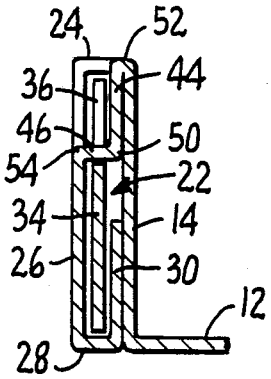
FIG. 9 is a sectional view taken along the line 9—9 of FIG. 8.

After formation of the channels the locking panels 34 are folded and inserted therein in the sequence shown by FIGS. 4–6. It will be noted that curved surface 38 of the lock tab 36 facilitates insertion of the lock tab and locking panel into the channels.

Channel panels 24 and 26 include detent means engageable with the lock tabs to positively lock the locking panels in the channels. Specifically, each detent means comprises a first detent section 44 separated by a first line of cut 45 from the remainder of the first channel panel. The detent means additionally comprises a second detent section 46 separated by a second line of cut 48 from the remainder of the second channel panel. The first and second detent sections 44 and 46 are connected along a fold line 50. First detent section 44 is connected to one side wall by a fold line 52 extending from the first line of cut 45. The second detent section 46 is hinged to the remainder of second channel panel 26 by a fold line 54.

It will be noted that an indent 60 is formed between lock tab 36 and the side wall, which in FIGS. 4–9 is side wall 18. As soon as the indent 60 is disposed in registry with first and second detent sections 44 and 46, the detent sections are manually pressed so that they assume the relative positions shown in FIGS. 7–9. It will be appreciated that with the detent sections in this illustrated position, locking panel 34 will be prevented from leaving the channel due to engagement between detent section 46 and straight surface 40 of lock tab 36. The locking panels cooperate with the channel panels to maintain them in a channel defining configuration. When the tray is completely assembled and locked, only a single baking surface of the unitary blank of paperboard material used in its construction is exposed to the interior of the tray.

I claim:

1. A baking and shipping tray formed from a unitary blank of paperboard material having a baking surface, said tray defining an interior and comprising:

a bottom wall;

a first pair of opposed side walls connected to said bottom wall along fold lines;

a second pair of opposed side walls connected to said bottom wall along fold lines;

channel defining members connected to each of said first pair of side walls, the channel defining members each comprising a plurality of channel panels folded relative to one another to define an open-ended channel and including a first channel panel extending outwardly from one of said first pair of side walls, a second channel panel extending downwardly from said first channel panel substantially parallel to said one side wall and spaced therefrom, a third channel panel extending from said second channel panel and inwardly toward said one side panel, and a fourth channel panel extending upwardly from said third channel panel and adjacent to said one side wall; and locking panels extending from the ends of each said second pair of side walls and positioned in said channels, said locking panels and said channel panels cooperating to maintain said first and second pairs of side walls substantially perpendicular to said bottom wall with only the baking surface exposed to said tray interior, said locking panels each including a lock tab positioned in a channel and at least some of said channel panels including detent means engageable with said lock tab to lock said locking panels in said channels, said detent means each comprising a first detent section formed in said first channel panel and separated by a first line of cut from a remainder of said first channel panel and a second detent section formed in said second channel panel and separated by a second line of cut from a remainder of said second channel panel and connected to said first detent section along a fold line, said first detent section being connected to said one side wall by a fold line extending from said first line of cut and said second detent section being connected to both said first detent section and said second channel panel by fold lines extending from said second line of cut.

2. A unitary blank of paperboard material having a baking surface and adapted to form a baking and shipping tray having an interior defined by the baking surface, comprising:

a bottom wall panel;

a first pair of side wall panels connected to opposite sides of said bottom wall panel along fold lines;

a second pair of side wall panels connected to opposite sides of said bottom wall panel along fold lines;

channel defining members connected to each of said first pair of side wall panels, each said channel defining member comprising a plurality of channel panels foldable relative to one another to define an open-ended channel and including a first channel panel connected to one of said first pair of side wall panels and adapted to extend outwardly therefrom, a second channel panel attached along a fold line to said first channel panel and adapted to extend downwardly therefrom substantially parallel to said one side wall panel and spaced therefrom, a third channel panel attached along a fold line to said second channel panel and adapted to extend inwardly toward said one side wall panel, and a fourth channel panel attached along a fold line to said third channel panel and adapted to extend upwardly from said third channel panel adjacent to said one side wall panel; and locking panels extending from the ends of each of said second pair of side wall panels and positionable in the channels when the tray is assembled to maintain the first and second pairs of side wall panels substantially perpendicular to said bottom wall panel with only the baking surface of the blank exposed to the tray interior, said locking panels each including a lock tab and said channel panels including detent means engageable with said lock tab upon formation of said channels to prevent said locking panels from leaving said channels, said detent means each comprising a first detent section formed in said first channel panel and separated by a first line of cut from a remainder of said first channel panel and a second detent section formed in said second channel panel and separated by a second line of cut from a remainder of said second channel panel and connected to said first detent section along a fold line, said first detent section being connected to said one side wall panel by a fold line extending from said first line of cut and said second detent section being connected to both said first detent section and said second channel panel by fold lines extending from said second line of cut.

* * * * *